United States Patent [19]

Cardinael

[11] Patent Number: 4,813,742

[45] Date of Patent: Mar. 21, 1989

[54] ORTHOPEDIC FOOTSTOOL

[76] Inventor: Barry P. Cardinael, 16300 Minnehaha St., Granada Hills, Calif. 91344

[21] Appl. No.: 137,524

[22] Filed: Dec. 22, 1987

[51] Int. Cl.[4] ..... A47C 9/12

[52] U.S. Cl. ..... 297/439; D6/349

[58] Field of Search ..... 297/438, 439, 175, 424; D6/349, 350, 362

[56] References Cited

U.S. PATENT DOCUMENTS

| | | | |
|---|---|---|---|
| D. 211,868 | 8/1968 | Spencer | D6/351 |
| D. 271,256 | 11/1983 | McClelland | D6/349 |
| D. 278,864 | 5/1985 | Borichevsky | D6/349 |
| D. 280,952 | 8/1985 | Hypponen | D6/349 |
| 442,781 | 12/1890 | Phillips | 297/439 |
| 2,244,440 | 6/1941 | Archer | 297/439 X |
| 2,576,883 | 11/1951 | Koski | D6/349 X |
| 3,155,364 | 11/1964 | Berg | 297/439 |
| 3,338,190 | 8/1967 | Hammond | 297/439 |
| 3,554,600 | 1/1971 | Hennessey | 297/439 |
| 4,549,767 | 10/1985 | Hampshire et al. . | |
| 4,678,234 | 7/1987 | Wilson | 297/439 |

FOREIGN PATENT DOCUMENTS

| | | | |
|---|---|---|---|
| 1654407 | 2/1971 | Fed. Rep. of Germany | 297/439 |
| 326062 | 5/1903 | France | 297/439 |
| 1093859 | 5/1955 | France | 297/439 |
| 1213251 | 11/1970 | United Kingdom | 297/439 |

*Primary Examiner*—Peter A. Aschenbrenner
*Assistant Examiner*—Thomas A. Rendos
*Attorney, Agent, or Firm*—Poms, Smith, Lande & Rose

[57] ABSTRACT

Disclosed herein is a footstool for use in conjunction with nursing or bottle feeding an infant. The footstool provides stable support for a mother seated while feeding or holding her baby. The footstool includes a skid resistant surface and rubber stud means for preventing the tilting and shifting of the platform while the mother is seated during the nursing of her child. The invention is especially designed so that the legs which support the inclined platform do not substantially extend outward from under the platform, allowing the entire frame to be more rigid and less susceptible to tilting which otherwise would occur when a force is applied to opposite edges of the footstool in the normal course of its use.

7 Claims, 1 Drawing Sheet

FIG. 1
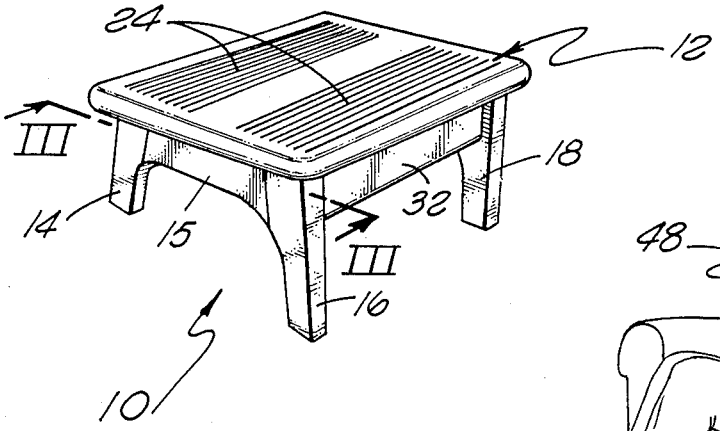
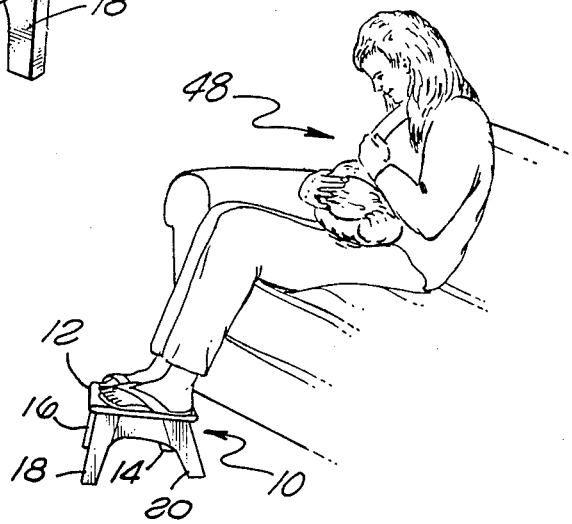
FIG. 2
FIG. 3
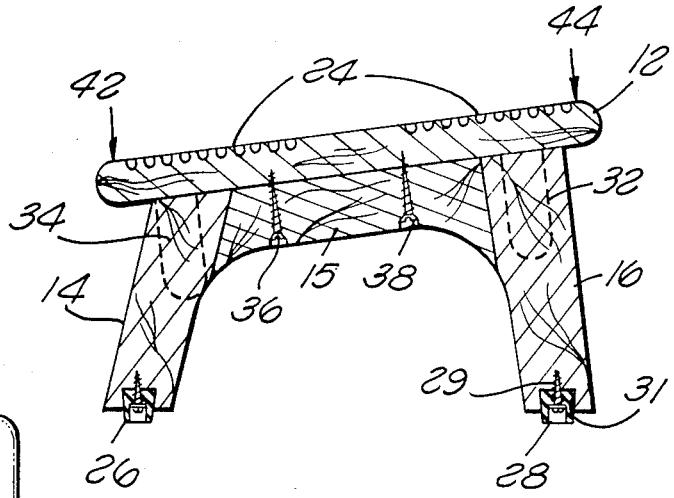
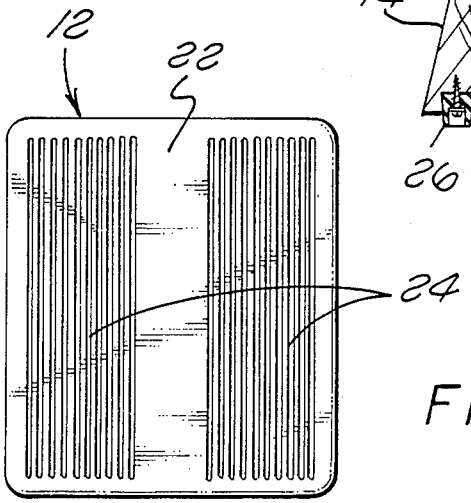
FIG. 4

ORTHOPEDIC FOOTSTOOL

FIELD OF THE INVENTION

This invention relates to footstools for elevating the feet of the user, and more particularly, this invention relates to an inclined footstool suitable for relieving strain and preventing orthopedic problems for users engaged in activities such as that of a mother nursing her baby.

BACKGROUND OF THE INVENTION

It is known that prolonged periods of sitting can cause foot, leg and lower back strain. Known common pains are felt by women who are seated while breast or bottle feeding a baby. These pains arise with the need to position the baby's mouth and the mother's breast or bottle together, while the baby is cradled in one arm of the mother. As is well publicized, breast feeding may be the result of natural maternal instincts, but it is not generally comfortable to most women while seated. At least three types of pain often result when a mother is seated on a couch or lounge chair during breast or bottle feeding. More specifically, the mother in breast feeding, may be subject to lower back pain, neck, shoulder and upper back pain, and, lower leg pain. The lower back pain arises from leaning forward and downward towards the child. Neck and shoulder pain arise from lifting and holding the child. Lower leg pain may result from trying to lift the lower legs to raise the lap as a place to rest the arm and the child.

When bottle feeding a baby, similar pains may arise when a mother raises the child's head slightly higher than the rest of its body and raises the child to hold it in intimate close and comforting positions. In both breast feeding and bottle feeding, the child is often cradled in one of its mother's arms which is laid partially or wholly across the lap.

In attempting to provide the footstool for use by a nursing mother, existing adjustable foot supports such as that indicated in U.S. Pat. No. 3,155,364 to Berg or U.S. Pat. No. 4,549,767 to Hampshire are directed to easing the plan of those who sit still over a long period.

Heretofore, prior art foot supports and ottomans are directed to a use where the user is primarily still, with very little movement. Anyone who has ever attempted to feed a baby, knows that any footstool that would ease the pain which arises would have to be suitable for a user that is constantly shifting their position, often involuntarily.

The above cited prior art references do not disclose a stable footstool which would both alleviate any possible pain arising from sitting, while acting as an adequate support to a user who is constantly shifting positions.

SUMMARY OF THE INVENTION

What is needed is an elevated footstool that provides an inclined top surface, and which is stable, orthopedically correct, and specifically designed to accommodate the particular needs of a mother who is breast or bottle feeding her baby.

To these ends, a footstool is provided which has stability and orthopedic support. The disclosed invention is particularly designed to the unique needs of mothers feeding their baby in a seated position.

This invention is directed to a stable supporting footstool having an inclined platform. The platform defines a plurality of edges. The platform has a substantially flat upper surface. To provide stability, the platform has at least four legs, two of which are positioned at opposite edges of the platform in order to support the inclined platform. The front and the rear pairs of legs are of unequal length. Each leg of each pair is positioned at an angle with respect to the inclined platform such that each leg contacts the floor below the platform at the outer edge of the perimeter defined by the edges of the platform.

The flat upper surface of the inclined platform may have transverse grooves carved into the surface, or skid resistant material such as parallel strips of rubber, to reduce slipping when the user repositions her body. For addition stability, each pair of unequal legs may be formed integrally from a single piece. For maximum stability, the platform and its supporting legs should form a fixed and rigid frame.

In the preferred embodiment, the underside of each of the legs supporting the inclined platform has a supporting rubber foot or anti-skid stud attached to the leg. The rubber studs are positioned in a cavity or recess extending into the lower surface of the leg from the underside of each leg. Each pair of legs may be formed in a flat, arch-shaped assembly or as a single piece. To additionally ensure stability, a pair of flat spanning members may extend between the two pairs of legs downward from the other two edges of the inclined platform.

This invention is also directed to a method of using an inclined footstool having a stable configuration for propping up the mother's legs at an upwardly inclined angle, where the steps of using the invention include the mother seating herself into a piece of furniture. The user's back then leans rearward into the furniture. The user then places her feet on the top surface of the footstool and adjusts her position to raise her lap, and in a position such that the user's legs below the knees are relatively parallel to the user's upper trunk. In this manner the stool allows repositioning of the user's body, as if the user allows repositioning of the user's body, as if the user were seated upright with respect to the relative position of the user's legs and upper body. The method of using the footstool of this invention includes use in conjunction with nursing a child. The footstool of this invention is directed for use to reposition the body of the user so that proper posture is enhanced where the upper torso of the user is relatively parallel to the user's legs below the knee. The invention disclosed is useful to prop up ones' feet on the inclined platform of the footstool and raise the mother's lap while nursing a baby, so that strain and the causes of pain enumerated above are eliminated. Additionally, the footstool is beneficial to anyone using a rocking chair. The stool top lies somewhat parallel to the natural seat top. The resting position of most rocking chairs gives the user proper posture, as well as providing a unit which is designed for use in motion. It also provides an ergonomically correct platform upon which the feet are placed when actively using a rocker. The seated user, who is less than average height is also aided, as well as the user that is performing lap activities such as reading a book, cutting out coupons, or needlepoint.

On a more specific basis, the footstool in accordance with the present invention may include one or more of the following features:

1. The footstool of the invention may be made of wood, or of a suitable plastic having a relatively low thermal conductivity, so that bare feet, or cloth covered feet will not feel cold.

2. The feet may be provided with non-skid rubber inserts or studs which provide good stability for the foot stool.

3. The upper surface of the stool may be tilted up at an angle of about eleven degrees, to provide good lower leg support. This angle may vary by a few degrees. The angle may fall in a range of 9–13 degrees.

4. The height of the footstool should be about 5 inches at the lower side, and about 7 inches at the higher side, with these dimensions being variable by two inches or so, to accommodate taller or shorter persons who may use the footstool. (The ratio of the shorter legs to the longer legs is about 2 to 3.)

5. The side to side width of the footstool should be in the order of 12½ inches, plus or minus about 2½ inches (for a range of about 10 to 15 inches) to permit easy stepping around the footstool when it is placed in front of a chair or sofa wherever it is to be used.

6. The front-to-back extent of the upper surface of the footstool may be about eleven inches plus or minus an inch or two, to accommodate normal foot lengths.

7. The upper surface of the footstool may be transversely grooved, for increased aeration and traction.

The foregoing and other features and advantages will be further explained in conjunction with the accompanying drawings and detailed description.

BRIEF DESCRIPTION OF THE DRAWINGS

FIG. 1 is a perspective view showing the top and corner of the orthopedic footstool of this invention;

FIG. 2 illustrates the primary use of the footstool shown in FIG. 1 for nursing a baby;

FIG. 3 is the side elevational view, partially in cross section, showing the footstool of FIG. 1 taken along lines III—III; and FIG. 4 shows a top view of the footstool and inclined platform of this invention, with particular emphasis on the skid resistent surface.

With reference to FIGS. 1 through 3, an orthopedically designed footstool 10 is shown generally in FIG. 1. The footstool 10 is comprised of an inclined platform 12 which is suported by at least four legs 14, 16, 18 and 20. The inclined upper platform 12 has an upper platform surface 22 which in the preferred embodiment includes a skid resistant surface 24.

The footstool of the subject invention is particularly designed with maximum stability in primary goal. In furtherance of that goal, the footstool of the preferred embodiment is characterized by at least two pairs of legs. Each pair of legs may be made from a single piece or a composite piece 15 of an arch shaped configuration for maximum strength and stability, defining legs 14 and 16 of unequal lengths. By placing at least one pair of legs on either edge of platform 12, an inclined position is defined for the platform 12 within the overall framework of the footstool 10. Span members 32 and 34 extend between pairs of legs to provide additional rigidity to the overall footstool 10 structure.

In order to prevent movement of the user's feet, a skid resistant upper surface 24 may be mounted on the upper surface 22 of the platform 12. Thus, shifting the position of the legs will not necessarily cause the user's feet to slip. The skid or slip resistant surface is comprised of a plurality of parallel transverse grooves 24 as shown in FIG. 4, preferably to allow foot aeration and traction. Rubber strips may run parallel to each groove or within the grooves as an alternative embodiment.

To further ensure stability, stud means 26 and 28 may be placed in the underside of each pair of legs. The stud means are preferably made from rubber, although other high traction materials may be used. The underside of each leg defines a stud receiving cavity, or recess such as 31, for leg 16. The stud receiving cavity receives the stud means which, may then be fastened into the cavity by a recessed screw fastener 29. In this manner, the rubber studs which are fixed to the underside of the legs prevent movement or slippage of the footstool when it is placed on a floor or other surface. By having the fastener 29 recessed into the stud means 28, the manner in which the stud means 26 and 28 are fastened to legs 14 and 16, respectively, do not interfere with their functional anti-skid role.

To ensure the relative stability and comfort of a mother 48 when using the footstool 10, it has been discovered experimentally by the applicant that the ideal configuration for the positioning of the footstool legs 14, 16, 18 and 20 relative to the platform 12, is to position them in such a manner that the legs do not extend outward beyond the perimeter of the upper platform surface 22 of the platform 12. Tests were made where forces were applied at both points 42 and 44 (FIG. 3) in an effort to tilt and wobble the footstool 10 of the subject invention. It has been discovered by the applicant that if one is to place the stud means 26 directly below the applied force 42, little or no torque is imparted to the footstool which would allow it to pivot about the stud means 26.

Likewise, the footstool is designed so that the stud means 28 of the leg means 16 is seated directly below the point at which an applied force 44 would cause the platform to tilt. By angling and positioning each pair of legs in the manner shown in FIG. 3, the applicant has achieved a stabilized configuration for the footstool of this invention.

In the preferred embodiment the legs may be within the perimeter of the upper platform surface 22 or extending no further beyond the platform surface 22 than a distance equal to one quarter inch. Positioning the legs substantially further out is undesirable in view of the possibility of tripping or interfering with the movement of others near the footstool. Likewise, it is desirable that the legs extend off vertical out from the underside of the platform to points near the perimeter of the platform forming the top of the footstool. In this manner both forward and backward rotation of the footstool 10 is avoided as the user 48 shifts her body weight in response to the dynamic process of feeding her baby.

While the preferred embodiment of the instant invention is primarily directed to an application of the invention as a foot rest during child feeding, other uses of the footstool may be envisioned primarily for people of less than average height, which include performing lap activities such as knitting, sewing or needlepoint which necessitate some movement or shifting of the user's body while seated. By providing a stable inclined surface, lower back pain; neck, shoulder and upper arm pain; and, lower leg pain, all normally associated with breast or bottle feeding of babies, is substantially reduced for the mother that uses the footstool of this invention. Although one specific embodiment has been described, it is to be understood that minor changes in dimensions and materials within the parameters outlined hereinabove, are within the scope of the invention.

What is claimed is:

1. A footstool providing stability and orthopedic support, particularly for a nursing mother, an inclined platform defining a plurality of edges and having a flat upper surface;

at least two pair of legs positioned at opposite edges of said platform for supporting said inclined platform;

each of said pair of legs having legs of unequal length;

each leg of said two pair of legs positioned at an angle with respect to said inclined platform such that each leg contacts a floor below said platform within a perimeter defined by the edges of said platform;

said legs being provided with rubber studs for engaging the floor and preventing slippage;

said inclined platform causing an angle of about ten to twelve degrees with the horizontal, with the higher edge of the platform being the front of the platform and stool, and the lower edge of the platform being the rear thereof;

the front of said platform being about five to nine inches high and the rear of said platform being about two inches lower;

said platform being formed of low thermal conductivity material, having surface grooves, and having an extent of about 10 to 12 inches front-to-back and about 12 to 13 inches from side to side; and the legs adjacent the front of said stool being mounted back from the front edge of the platform and being oriented substantially perpendicular to said platform.

2. The footstool of claim 1, wherein:

each pair of legs, having legs of unequal length, have a shorter leg and a longer leg, with the ratio of the shorter leg to the longer leg being about 2 to 3.

3. A footstool providing stability and orthopedic support, comprising:

an inclined platform defining a plurality of edges and having a flat upper surface;

at least two pair of legs positioned at opposite edges of said platform for supporting said inclined platform;

each of said pair of legs having legs of unequal length; and each leg of said two pair of legs positioned at an angle with respect to said inclined platform such that each leg contacts a floor below said platform within a perimeter defined by the edges of said platform;

skid resistant means provided along the upper surface of said platform;

each pair of unequal length legs being formed as an arch extending from within the surface of the platform outwardly to points substantially at the perimeter of the projection of the platform on a supporting surface;

the platform and its supporting legs forming a fixed and rigid frame;

the underside of each of said legs supporting said inclined platform having a non-skid stud means attached to said leg by recessed securement means;

said inclined platform being tilted at an angle within the range of 9–13 degrees above the horizontal.

each pair of legs including legs of unequal length, with the higher side of said platform being the front thereof, and being about $5\frac{3}{4}$ inch to 7/34 inches in height; and the opposite side of said platform forming the rear thereof and having a height of about two inches less than the front thereof; and the transverse dimensions of said inclined platform being in the range of $10\frac{1}{2}$–$14\frac{1}{2}$ inches the legs adjacent the front of said stool being mounted back from the front edge of the platform and being oriented substantially perpendicular to said platform.

4. The footstool of claim 3, wherein:

a pair of flat span members extend between said two pair of legs downward from an edge of said inclined platform.

5. The footstool of claim 3, wherein the skid resistant means provided along the upper surface comprises:

a plurality of transverse spaced apart grooves in the upper surface of said inclined platform, providing aeration and traction.

6. The footstool of claim 3, wherein said footstool is made from a material selected from the group consisting of wood and low thermal conductivity plastic.

7. The footstool of claim 3, wherein the non-skid stud means are rubber inserts and the recessed securement means is a screw fastened through each insert into the underside of each leg.

* * * * *